United States Patent [19]

Green

[11] Patent Number: 4,463,469

[45] Date of Patent: Aug. 7, 1984

[54] AUTOMATIC BOWLING LANE MAINTENANCE MACHINE

[75] Inventor: Sheldon R. Green, Township of New Franken, Kewaunee County, Wis.

[73] Assignee: Lois G. Hickey, Greenleaf, Wis.

[21] Appl. No.: 391,159

[22] Filed: Jun. 23, 1982

[51] Int. Cl.[3] ..... B24B 29/00

[52] U.S. Cl. ..... 15/98; 15/50 R

[58] Field of Search ..... 15/98, 50 R, 50 A, 50 C, 15/51, 340, 4; 118/108, 109, 111, 207

[56] References Cited

U.S. PATENT DOCUMENTS

| | | | |
|---|---|---|---|
| 1,517,980 | 12/1924 | Green | 15/98 X |
| 2,978,721 | 4/1961 | Simmons | 15/98 |
| 3,150,395 | 9/1964 | Lucky | 15/98 |
| 3,418,672 | 12/1968 | Regan | 15/98 |
| 3,868,738 | 3/1975 | Horst et al. | 15/98 |
| 4,246,674 | 1/1981 | Ingermann | 15/98 X |

*Primary Examiner*—Edward L. Roberts

*Attorney, Agent, or Firm*—Recka & Joannes

[57] ABSTRACT

An automatic bowling lane dressing applicator and buffer comprising a machine to which are mounted suspended pivotally mounted blade buffers having resilient buffing pads mounted on the periphery of the blades, which buff dressing placed on the lane surface in front of the buffer onto the lane surface, transferring excess dressing into the ball contact area of the lane as the machine is run backward and forward along the lane.

8 Claims, 13 Drawing Figures

AUTOMATIC BOWLING LANE MAINTENANCE MACHINE

BACKGROUND OF THE INVENTION

1. Field of the Invention

The invention is a bowling lane maintenance machine used for periodically applying a dressing compound to a bowling lane and then speading and buffing the dressing onto the bowling lane.

2. Description of the Prior Art

Lane dressing is applied to a bowling lane to lessen wear due to the impact and skidding of a bowling ball. Preferably the dressing is applied only part way down the lane starting at the foul line with the heaviest coating is applied in the area where a thrown bowling ball impacts and skids, with the coverage thinning out towards the edges of the lane.

Complicating the problem of applying lane dressing in the required amounts and location is uneven wear of the lane. The heaviest area of lane wear is in the impact area of a ball thrown by a right handed bowler. Other application problems arise from warping and imperfections in the lane surface.

Prior art devices such as McNeely U.S. Pat. No. 3,321,331, Rockwood et al., U.S. Pat. No. 3,216,036 and Varner, U.S. Pat. No. 3,604,037 use at least one horizontally mounted roller or bristle brush that extends longitudinally from one gutter to the other across the lane and which rotates about an axis parallel to the lane surface, in brushing contact with the surface, as the maintenance machine traverses the lane.

The rotating bristles or brush can not adequately contact and brush the ball contact area which is depressed below the horizontal surface of the lane. The raised ares on each side of the depressions hold the brush above the depression. Vertical irregulaties and warped areas are also not brushed well. A parallel rule extended across a lane, from gutter to gutter, would show a substantial depression in the ball contact area and would show irregularities in other localized areas where the flooring of the lane has dished, warped or loosened.

Dressing is applied in small amounts to the lane to be dressed. For example McNeely U.S. Pat. No. 3,321,331 uses a sprayer nozzle to produce a mist of dressing oil that falls onto the lane to be buffed. It is preferable to have the dressing put down more heavily in the ball contact: this area is to the right of center on the lane. A mist does not allow varying the amount applied. Other devices such as Rockwood et al. U.S. Pat. No. 3,216,036 apply oil to a transfer roll which selectively engages the buffing roll, when oil is to be applied or they directly apply dressing oil to the buffer. Heavier dressing is applied to that part of the roll which brushes the ball contact area.

The competitive devices require pumps for spray of dressing or a plurality of rolls. In the invention dressing is applied directly to the lane surface by porous pads, eliminating valves, motors and the need for extra rolls. Buffing is performed by rotating blades which rotate about a vertical axis rather than about a horizontal axis.

BRIEF SUMMARY OF THE INVENTION

The invention comprises a machine that is started while positioned at the foul line of a bowling lane, then traverses a measured distance down the bowling lane, applying dressing and buffing the dressing and then returns to the foul line to stop.

Buffing and spreading of dressing is accomplished by a plurality of buffing blades having pads mounted at the ends of the blades. The blades rotate about an axis normal to an imaginary line extending across the bowling lane from gutter to gutter. This is in contrast to prior art devices which comprise one or a series of buffing rollers rotating about an axis parallel to such a line.

The blades are pivotally mounted to allow the pads to buff through vertical irregularities in the lane surface and to contact the complete surface. The blades further are of unequal length. The center blade being longer and mounted ahead of the blades on each side. This provides an overlap of the buffed area in the ball contact area of the lane, which is the area most likely to be worn down and which needs the most dressing.

The blades further rotate in an ordered sequence so that excess oil is transferred to the primary ball contact area. Observing the machine as the machine moves down the lane, the left blade is seen to rotate in a clockwise fashion, the center blade also rotates in a clockwise direction. The right blade rotates in a counterclockwise direction.

Excess dressing is moved by the first blade to the intersection of the area buffed by the center blade. The dressing is carried to the right, to the intersection of the buffed area of the center blade and kept there until buffed on to the lane by the counter-rotating right blade.

Dressing is placed directly on the lane surface by a series of pads mounted to a dressing reservoir, which is pivotally mounted to the frame. No valves are used. The amount of dressing and the location of the dressing is determined by the number and location of the applicators.

It is an object of the invention to provide a machine that can be set to automatically traverse a lane to be dressed and to cover the lane surface with a predetermined amount and dispersion of lane dressing and to buff such dressing on to the lane surface.

It is an object of the invention to provide a machine that can without valves, pumps or auxiliary dressing application rolls apply a measured amount of dressing oil to a lane surface.

It is an object of the invention to provide automatic buffing and drive with a single electric motor.

DETAILED DESCRIPTION OF THE INVENTION

The invention is a bowling lane maintenance machine used for applying a dressing compound to the bowling lane surface and then buffing the dressing onto the lane surface.

A frame is provided with drive and support wheels for powering the machine up and down a bowling alley. Handling rollers are provided for tipping the machine up on end for storage and for moving the machine to and from bowling lanes.

Guide means are provided for maintaining the orientation of the machine as it traverses up and down the lane.

Drive means includes an electric motor connected with driving wheels.

Dressing reservoir and dressing application means is pivotally mounted to the frame the reservoir extending the width of the lane. The application means is pivotally mounted so as to be operable by a solenoid to force oil application pads against the lane surface as the reservoir is pivoted. The application means facilitates applying varying concentrations of dressing to the lane surface so that certain portions of the lane receive different amounts of dressing.

Buffing means comprising a plurality of blades each operating either clockwise or counterclockwise are provided to spread and buff the dressing, and to transfer excess dressing to the ball contact area. Buffing blades are pivotally mounted so that the associated buffing pads can buff and apply dressing to depressed lane surfaces.

FRAME SERIES

Storage transport casters for moving the device, while tipped up, are mounted on the end of the frame.

Lane to lane transport, while the machine is lying flat in operating condition is provided by casters which roll on the lane transport area. These casters are mounted on the edges of the frame and hang over the gutter when the machine is inserted into the lane.

As the machine is inserted idlers take up the weight and allow the machine to be inserted without the operator having to overcome the resistance of the drive rolls. As the machine is fully inserted the weight of the machine is born by the drive rollers and rear support casters.

Indexing is provided by four spring biased indexing wheels.

Figure 1:
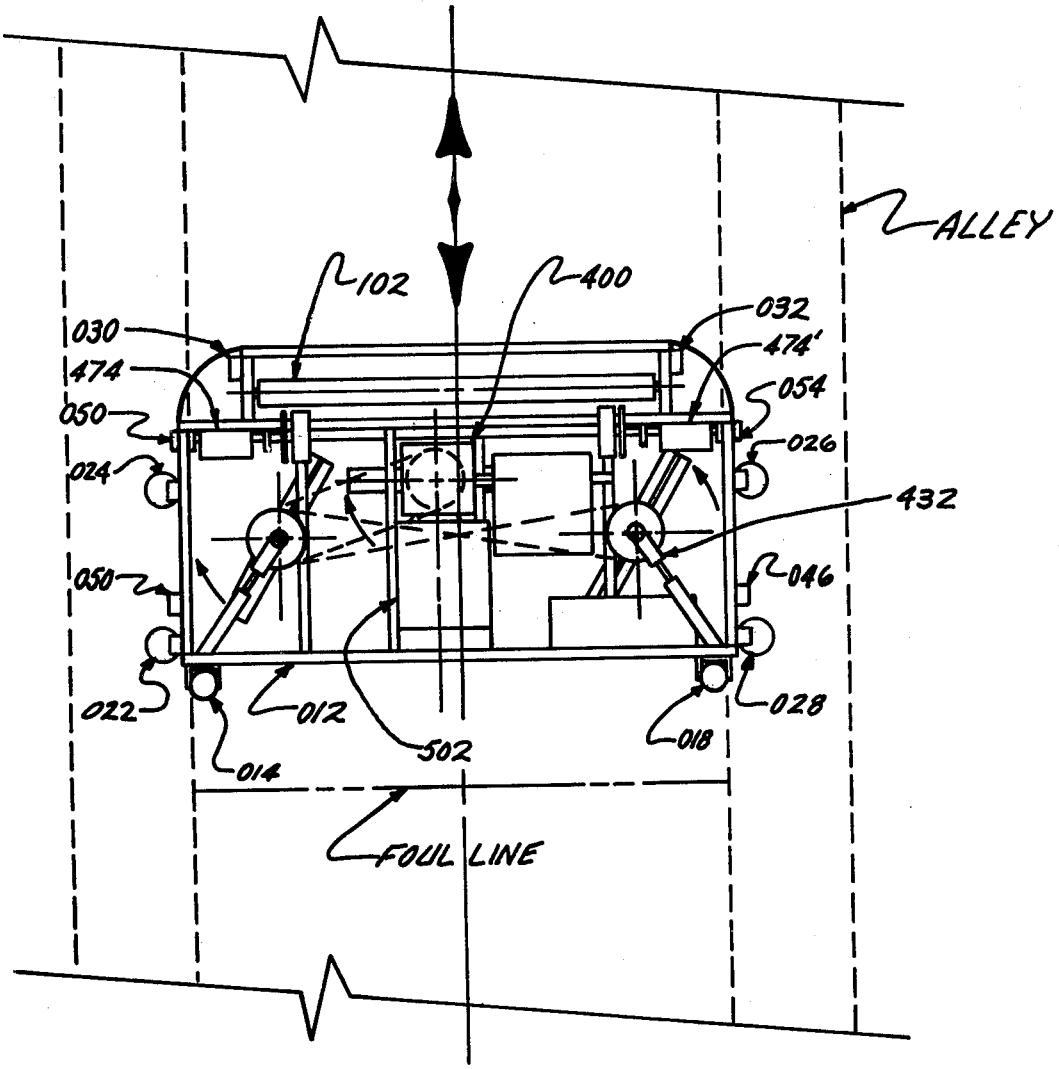
FIG. 1 is a top view of the device with the cover off, with a section of a bowling lane being shown, the gutters being shown in a dotted line.
Figure 2:
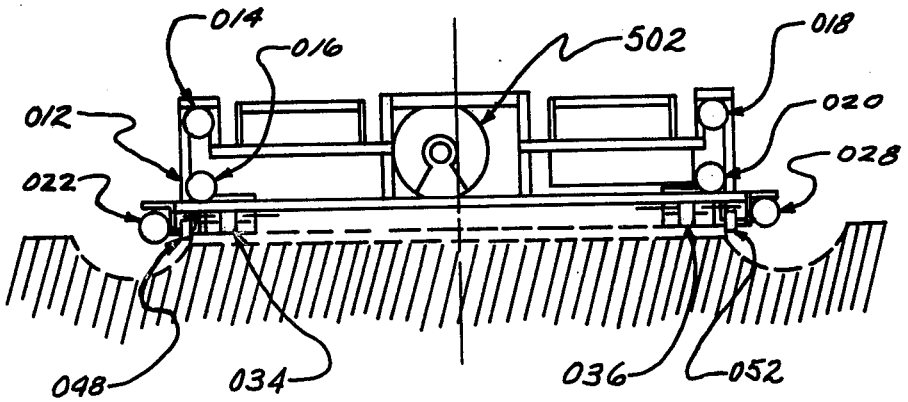
FIG. 2 is an end view of the device positioned on a bowling lane, hanging over a gutter and indexing on the edge of bowling lane.

The frame can best be seen in drawing FIGS. 1 and 2.

Storage transport casters 014, 016, 018 and 020 are mounted on the corners of the frame 12 as can best be seen in drawing FIG. 2. These casters support the device and allow it to be rolled when the device is tipped into a vertical position. Such vertical storage takes up substantially less space than would be required if the device was to be stored in the horizontal position in which the device is operated.

Lane to lane transport is accomplished by rolling on casters 022, 024, 026, and 028. These casters contact and roll on the lane approach area when the device has been placed in a horizontal position for operation.

When the device is placed on a bowling lane, the casters 026 and 024, mounted at the front of the machine drop into the lane gutter. Guide in idlers 030 and 032 then take up support of the front of the machine as the machine is rolled into place on the lane. The function of idlers 030 and 032 is to ease the machine on to the lane and off the lane. At insertion they hold the machine up so that drive rolls 474 and 474' do not contact the lane surface making it difficult to put the machine on the lane.

Rear support idlers 034 and 036 support the rear of the machine after the machine is fully inserted and rear transport casters 022 and 028 no longer support the machine, having dropped into the gutters. When support is transferred to idler 034 and 036 because of the angle of the machine, guide in idlers 030 and 032 no longer contact the lane surface. At that point support of the machine is by drive rolls 474 and 474' and rear support idlers 034 and 036.

The machine must be indexed between the two gutters so that it is centered on the lane and travels down the center of the lane.

Figure 3:
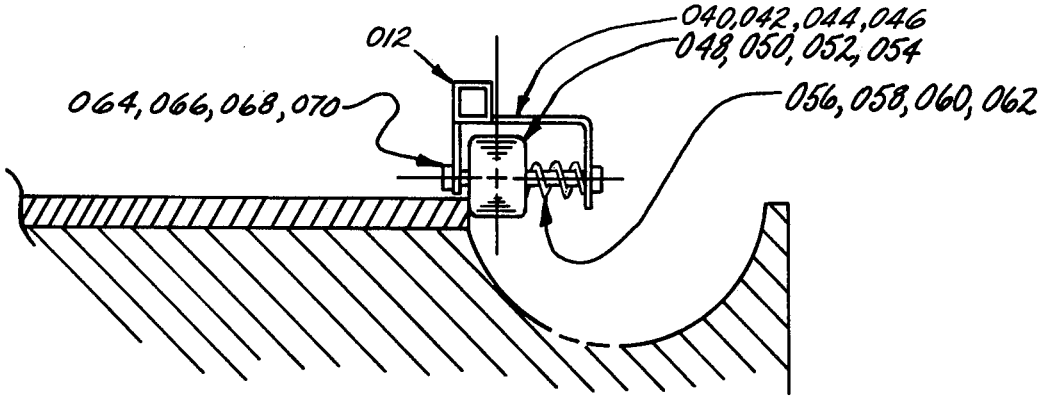
FIG. 3 is a sectional view of the machine indexing wheels positioned on a bowling lane.
Figure 4:
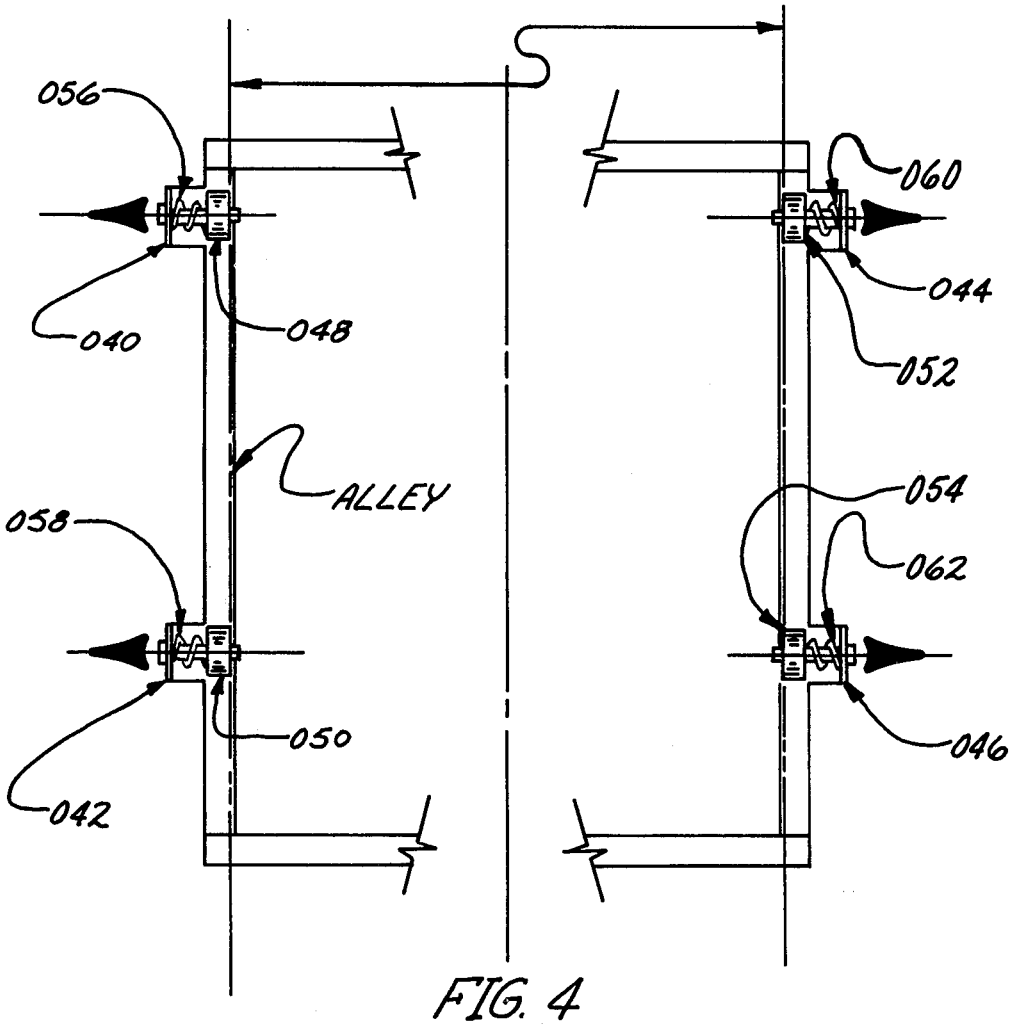
FIG. 4 is a partial fragmentary top view of the four indexing devices, indexing on the edges of the bowling lane.

The indexing and centering of the device is accomplished by the mechanism shown in drawing FIGS. 3 and 4. This mechanism comprises mounts 040, 042, 044 and 046. Within such mounts are indexing wheels 048, 050, 052 and 054. These wheels contact and are spring biased against the side of the lane by springs 056, 058, 060 and 062. The wheels are mounted on axles 064, 066, 068 and 070. As the machine moves down the lane the indexing mechanism urges the wheels against the side of the lane keeping the machine centered on the lane.

LANE DRESSING SERIES

The lane dressing oil reservoir is a tube like reservoir extending across the lane. The tube is pivotally mounted and is pivoted by a timer actuated solenoid. The reservoir has a series of ports tapped into it. Some of the ports are plugged. Others have threaded hollow tubes, housing pads at their ends, such tubes being screwed into the openings and allowing oil to pass out of the reservoir.

When the oiler is at rest, either with the machine in storage and stored vertically or when placed on the lane, the oil level is below the opening in the ends of the tubes so the oil cannot leak out.

When the machine is placed on the lane and the solenoid engaged, rotation of the reservoir causes the tubes to move below the level of the dressing oil and the oil to flow out of the tube. The tubes are capped with replaceable oil applicator pads. The pads are forced against the lane surface when the solenoid is actuated and oil is thereby applied to the surface.

Mounted on frame 12 and extending across frame 12, normal to the direction of travel of the machine on the lane is lane dressing oil reservoir 102. This reservoir 102 can be seen extending across the frame in drawing FIG. 1. Detail of the dressing oil application mechanism 100 is shown in drawing FIGS. 5, 6, 7 and 8.

The oiler mechanism 100 comprises oil reservoirs 102 mounted in bearings 104 and 106. The oiler must be mounted so that it is generally parallel to the lane surface. Adjustment for leveling the oiler is provided for by oil reservoir levelers 8 and 110.

Figure 5:
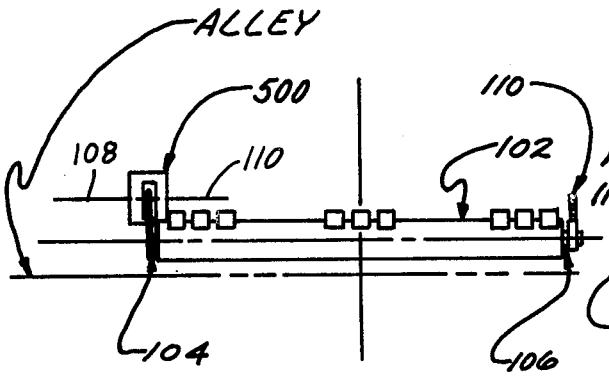
FIGS. 5 and 6 constitute an enlarged view of the dressing application mechanism and its operating solenoid broken away for clearer illustration. The views show the dressing applicators disengaged from the lane surface.
Figure 6:
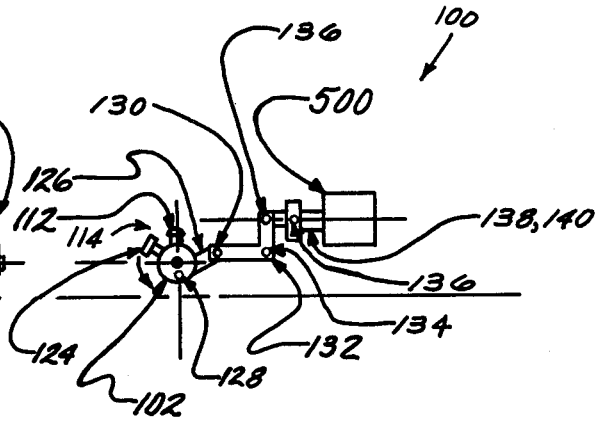
Figure 7:
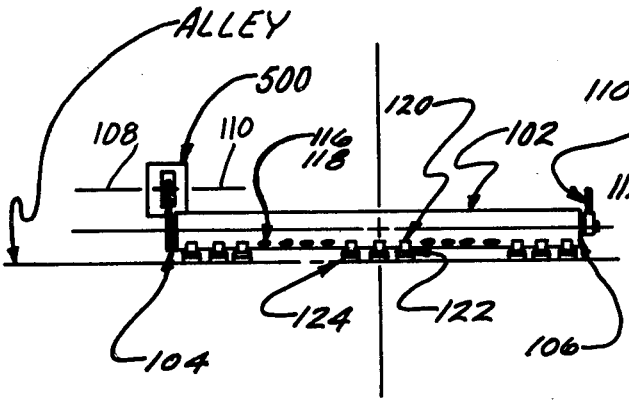
FIGS. 7 and 8 constitute an enlarged view of the dressing application mechanism and its operating solenoid broken away for clearer illustration. The views show the dressing applicators engaged with the lane surface.
Figure 8:
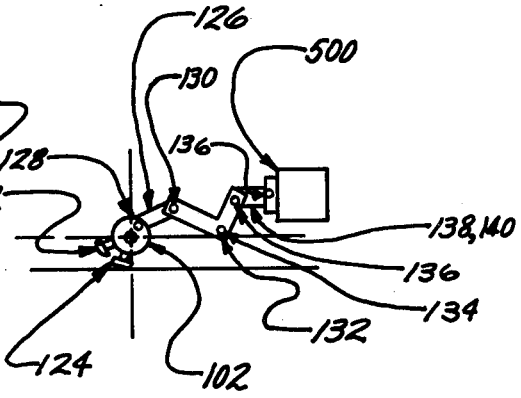

Drawing FIGS. 5 and 6 show the oiler in an upright non-oiling position. Filler 112 and oil applicator 114 can best be seen in drawing FIGS. 6 and 8. Oil is inserted in the reservoir through filler 112. The reservoir is pivotally mounted. When pivoted forward oil applicator 114 allows the oil to flow out of the reservoir and onto the lane surface.

The reservoir 102 is pierced by a series of threaded openings 116 drilled into it. Some of these openings 116 are plugged—others have oil application mechanisms connected through such openings 116 and into the reservoir. Plugs 118 can be removed and oil applicator 114 can be inserted to vary the amount of oil applied, for example, two or more can be inserted close together to increase desired oil flow in certain areas.

The applicator 114 is inserted into the reservoir 102 through openings 116. The applicator comprises a hollow tube 120, a pad holder 122 and a pad 124.

The pads 124 contact the lane surface and apply the lane dressing oil directly to the lane.

Pivoting the oil reservoir 102 causes the pads 124 to contact the lane surface and the oil to flow directly from the reservoir 102, by gravity, without the need for valving or pressurizing the oil to cause it to flow.

Rotating the oil reservoir 102 is accomplished by means of oil rotating Solenoid 500.

Attached to oil reservoir 102 is reservoir connecting lever 126. This is best seen in drawing FIG. 8.

Connected to and pivotally mounted to lever 126 by connecting pins 128 and 130 is shift lever 132.

Shift lever 132 is pivoted on connecting pin 134 and is attached to oiler rotating solenoid actuating arm 138 by connecting pin 136. Adjustment of rotational movement of the oiler is by oiler rotating solenoid actuating arm adjustment 140.

BUFFER SERIES

Buffing is accomplished by a plurality of padded blades, each having a pair of replaceable buffing pads mounted on the ends of the blades. The blades are pivotally mounted on the ends of their drive shafts. The pivotal mounting allows the pad to buff depressed or warped areas of a lane.

The individual blades are rotated in a particular sequence so that excess dressing is transferred to the ball contact area. This is done by having the left blade of a machine moving down lane rotating clockwise, the center blade clockwise and the right blade counter clockwise. On reverse of machine travel, this sequence is reversed, again transferring excess oil to the ball contact area.

The blades are of unequal length and are staggered in location so that the ball contact area is overlapped in buffing.

Buffing of the lane surface and application of lane dressing to the lane surface is done by a plurality of buffing blades; 414, 426 and 426'. The blades are driven by motor 502 which, through belts and gearing also drives the drive wheels which move the machine up and down the lane.

Figure 9:
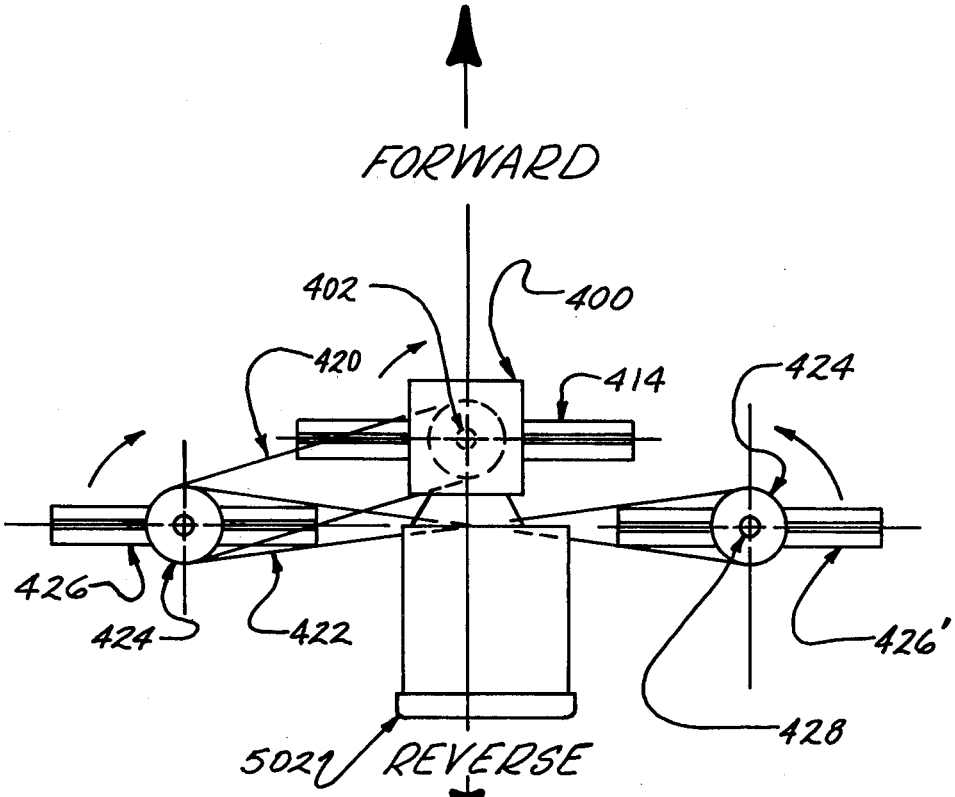
FIG. 9 is a top view of a fragmentary section, showing the buffer drive mechanism.
Figure 10:
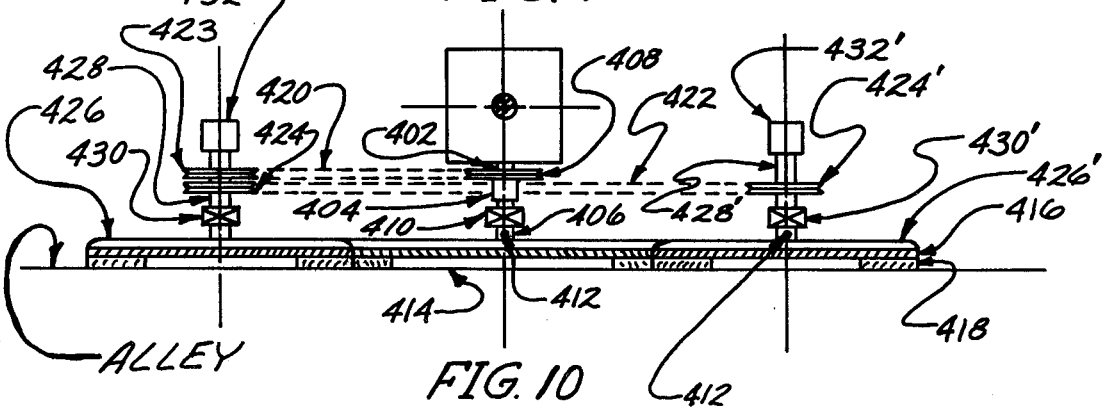
FIG. 10 is a sectional side view of the buffers and buffer drive mechanism.

The buffing mechanism is best shown in drawing FIGS. 9 and 10.

The buffing mechanism is powered by motor 502. Attached to motor 502 is 90 degree gear reducer 400; extending out of gear reducer 400 is gear reducer drive shaft 402. Such drive shaft 402 is coupled to blade 414 by coupling 404.

In detail, the buffing mechanism comprises drive shaft 406 and drive pulley 408. Drive shaft 406 drives buffing blade 414. Power to buffing blades 426 and 426' is taken off shaft 402 through drive pulley 408. Drive shaft 406 is supported by bearing 410.

The blades 414, 426 and 426' extend the width of the bowling lane and buff and apply lane dressing oil the width of the lane.

Because of wear and warping a bowling lane is not flat when measured from one gutter to the other gutter. Wear is especially heavy in the "ball track" area. This is the part of the bowling lane upon which right handed bowlers tend to land the bowling ball. It is in this area that it is difficult to apply lane dressing to the surface. It is also in this area that lane dressing should be heavy to lessen the wear and abrasion problems caused by ball impact and sliding.

To aid in application of dressing to the irregular surface blades 414, 426 and 426' are pivotally mounted at the ends of their respective shafts. Blade 414 is pivotally attached to shaft 406 at pivoted attachment 412.

Buffing is accomplished with pads 418 which are approximately 3 inches by 2 inches mounted at the ends of blade 414, by means of velcro material 416 affixed to the bottom of blade 414.

The pivotal movement of the blade causes it to drop into and track over depressions in the lane surface. The resilient buffing pads also aid in dressing irregular surfaces and depressions.

The direction of rotation of blades 414,426 and 426' is also important.

Blades 426 and 426' rotate in opposite directions to urge the dressing oil to the ball contact area on the right of the center of the lane. Blade 414 operates in a clockwise direction when the machine is going forward. This causes excess lane dressing to be transferred to the ball impact area. When the machine is reversed, again the direction of rotation is such to cause the lane dressing fluid to be built up in the ball impact area.

Blades 426 and 426' are 12 and one half inch blades, smaller than the center blade which is 16 inches. This causes an overlap in application of the lane dressing and the blades overlap at the center of the lane depression in the impact area.

Blades 426 and 426' are pivotally mounted at the ends of shafts 428 and 428'.

Drive belt 420 is connected to drive pulley 408 and drive pulley 423. On the same shaft as is mounted drive pulley 423 is transfer pulley 424. Belt 422 connects pulleys 424 and 424'.

Shafts 428 and 428' are supported at one end by bearings 430 and 430' which are self aligning bearings fixedly mounted in the frame. The top support bearings 432 and 432' are shown in drawing FIG. 1. These are self aligning bearings hung from the frame and adjustable means of a turnbuckle.

DRIVE SERIES

Drive is accomplished by a pair of drive wheels mounted at the front of the machine. The wheels are operatively connected to the single electric motor by a series of belts and gears.

The machine is driven up the lane and back by drive wheels 474 and 474'.

Figure 11:
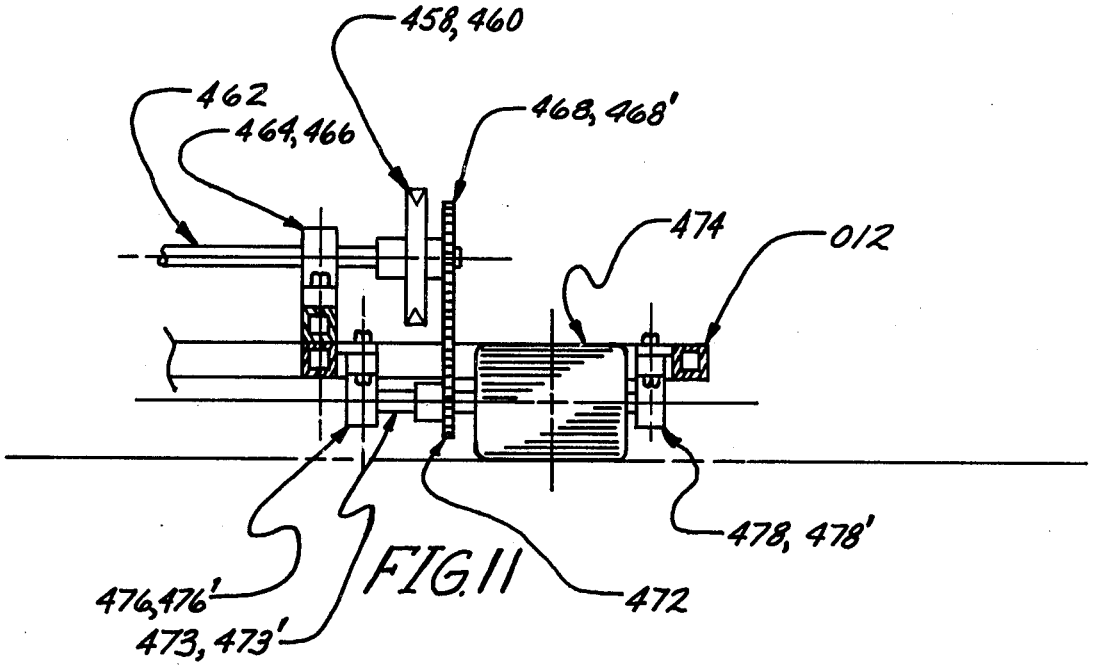
FIGS. 11 and 12 are sectional views showing the drive mechanism for the device; again broken away for clearer illustration.
Figure 12:
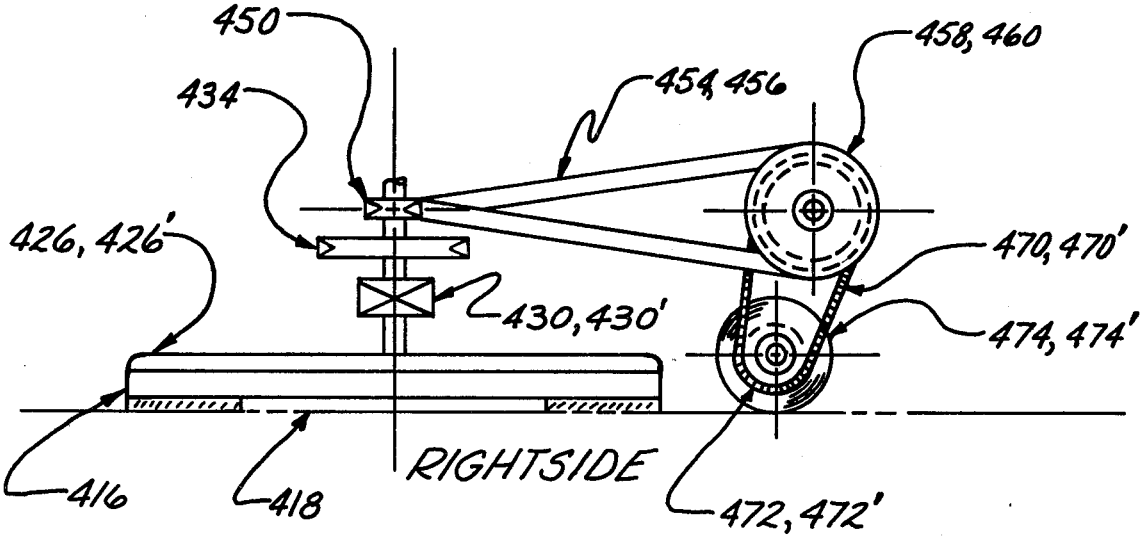

The drive mechanism is best shown in drawing FIGS. 11 and 12. A top view of the drive mechanism can be seen in drawing FIG. 1.

In detail the drive mechanism comprises a pulley 450 mounted on shaft 428 which drives wheel 474, and a pulley 450' mounted on shaft 428' which drives wheel 474'.

To transfer power from pulley 450 and pulley 450', V belts 454 and 456 are used.

Transfer is made to an upper drive assembly, comprising a cross shaft 462 which extends across the machine and is supported at two ends by bearings 464 and 466.

Mounted on an extension of cross shaft 462 is final drive 458 at one end of the shaft, and final drive pulley 460 mounted at the other end. V belts 454 and 456 previously mentioned, are connected to and drive these pulleys. Fixed to the outer end of cross shaft 462 is uppper drive sprocket 468 at the other end of cross shaft 462' is fixed upper drive sprocket 468'.

Drive wheels 474 and 474' are mounted on axles 473 and 473'. The axles themselves are mounted in bearings 476 and 478 at each end of the shaft. Wheel 474' is mounted on axle 473' in bearings 476' and 478'.

Driven sprocket 472 is fixedly mounted on axle 473 as is 472' and 473'.

Drive sprockets 468 and 468' are connected to driven spockets 472 and 472' by drive chains 470 and 470'. This completes the transfer of power from pulleys 450 and 450' to drive wheels 474 and 474'.

ELECTRICAL SERIES

The electrical system comprises an electric motor, a series of timers and safety switches.

One timer is used to set the distance the machine will travel down the lane. A delay timer is provided to let the motor stop before the motor is reversed, and the machine returns to the foul line where a limit switch turns it off.

A seperate and independent timer operates the dressing oil applicator solenoid. Finally a safety limit switch is provided to shut the machine off, if the timers are set incorrectly and reaches the far ent of the lane.

The electrical system comprises three parts, drive motor 502 control circuitry and a solenoid 500 for actuating the oiler.

Figure 13:
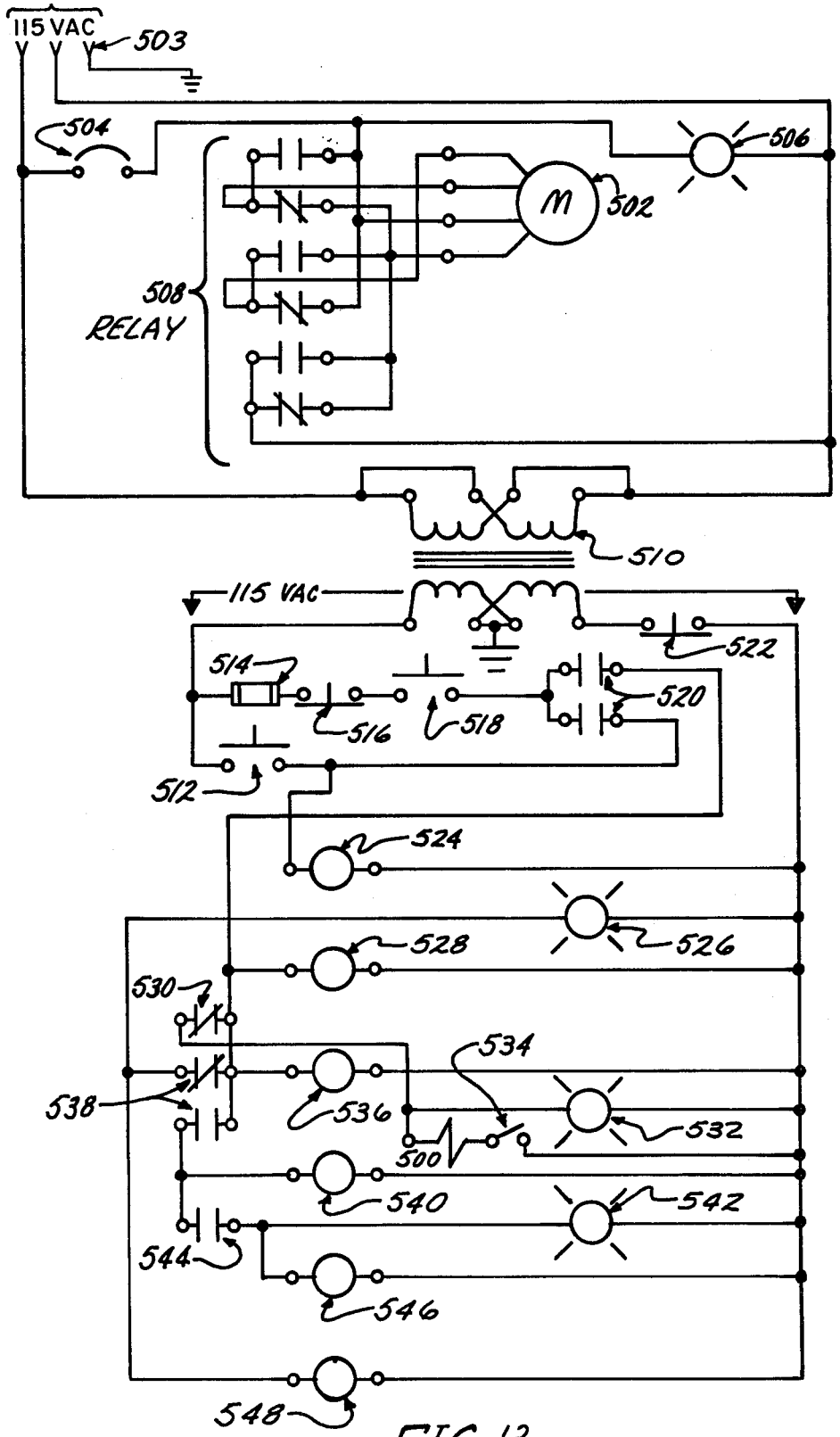
FIG. 13 is a wiring diagram illustrating a preferred control circuit for automatic operation of the machine.

The electrical system is best seen in drawing FIG. 13. Drive motor 502 and oil actuating solenoid 500 can also be seen in FIGS. 1 and 2 and 7 and 8 respectively.

Power is supplies to the machine through three prong flanged inlet receptacle 503. Booster transformer 510 is wired to boost incoming voltage 20 percent to overcome voltage drops. The boost is necessary for operation of the control circuitry.

Circuit breaker 504 provides protection to drive motor 502 from overloads or overheating. The circuit breaker 504 is a toggle switch type and allows the two circuits to be seperated. The control circuit can then be operated without running the motor.

Power indicator lamp 506 lights when there is incoming voltage. Motor switching relay 508 when controlled by the control circuitry causes motor 502 to drive the machine forward or to return.

Starting contact 512 is normally open and is the start switch that starts the machine through its functions. In-line fuse 514 protects the control circuitry and solenoid.

There are two limit switches, (1) foul line limit switch 516 which shuts the machine off after it has gone through a cycle up and down the lane and, (2) pit limit switch 518 which shuts the machine off in the event that there is a failure in setting the lane distance to be traveled. This switch is to prevent the machine from falling off the end of the lane.

Master control relay 524 is engaged by pushing of start switch 512 and holds the circuit closed through a cycle of the machine. The master control switch itself is shown at 520.

Emergency stop switch 522 is just that. The switch is mounted on the top of the machine.

Forward motion indicator lamp 526 is lit when the machine is moving in a forward direction.

Dressing is applied to the lane by rotation of the oil reservoir, by solenoid 500. Dressing is applied by direct contact of the oiler pads 114 with the lane surface. The solenoid is engaged with a dressing oil timing relay 528, the relay contacts are shown at 530. As long as the dressing timer is engaged oil indicator lamp 532 will be lit. An on-off switch is provided so the user can buff without oiling.

The distance the machine travels down the lane is determined by a timer 536, the contact points of the timer being shown at 538.

The machine travels down the lane then returns. The timer 536 when reaching the end of the forward cycle stops; engages delay relay 540, 544 which stops the machine long enough for motor 502 to stop rotating. This is to prevent injury to the motor 502. Light 542 comes on when the machine is returning.

Switch 546 actuates relay 508 and causes the machine to run in reverse. Switch 548 is the forward switch.

MODE OF OPERATION OF INVENTION

The mode of operation of the device previously described in detail, includes the motor controls, buffer, transport and oiler.

The device is operated by a single ½ horsepower, 115 volt reversible motor, shown in the drawings as FIG. 502.

Power is transmitted from the motor to the buffer and drive through a right angle 5 to 1 reduction gear case, shown in the drawings as FIG. 400.

Controls are provided for three functions. Those functions are down lane travel, oil application time and delay for reversing.

Down lane travel is set by the travel distance timer, which is a 0 to 30 second solid state timing relay. Oil application distance is determined by the oil distance timer relay, which operates the solenoid which by rotating oil reservoir forces the oiler pads into contact with the lane. This is also a 0 to 30 second timing relay.

A delay timer which is a 0 to 5 second relay is provided to give an appropriate delay for the motor to stop completely, prior to reversing direction of the motor.

The timers are solid state relays. They are sensitive to variations in line voltage. Bowling alleys often have substantial variations in voltage. To deal with this problem a 20 percent booster transformer is used to boost voltage entering the control circuitry.

The buffer system comprises three blades. The blades turn at 345 R.P.M. Two of the blades are 2 inches by 12 inches: the center blade is 2 inches by 16 and ½ inches. The center blade is mounted forward of the other two blades in such a fashion so there is an overlap of the buffed area without the blades hitting each other.

A lane is 42 inches wide. The perimeter of the area buffed extends from approximately one edge of the lane to the other.

At two of the buffed areas on the lane there is an overlap of about ½ inch so there is no demarcation between areas buffed by different blades.

The blades are driven so that on travel toward the pin area, the center blade is turning clockwise, the left blade clockwise and the right blade counterclockwise. This causes any extra oil to be transferred to the right ball contact area of the lane surface.

On reversal, blade rotation is reversed and again the ball contact area has the excess oil transferred to it. This area is the heaviest used area on the lane.

The blades themselves are aluminum T stock 2 inches wide and either 12 inches or 16½ inches long.

Adhesively attached to the bottom of the blade is a ⅜ inch thick resilient neoprene sponge pad. This acts as a shock absorber between the machine and the lane surface. Adhesively attached to the neoprene surface is "Velcro" loop material.

Buffing itself is done by 2 inch by 3 inch pads. These are replacable pads, which have affixed to their backs velcro hook material. This material allows the pad to be removably secured to the buffing blades. The pads are mounted at the outer ends of the blades.

Pads are placed at the outer edges of the blades rather than on the whole blade. This allows surfaces to be buffed that are less then perfectly flat. The pivotal mounting of the blade, the resilient neoprene pad and the mounting of the buffing pads only at the outer edge of the blade, all contribute to increased uniformity of coverage on worn and defective lane surfaces.

As stated, gearing is set to rotate the blades at 345 R.P.M. Operation of the blades at a faster speed throws oil into the gutters at a slower speed less buffing is done on each cycle.

The machine is geared to move at 2 and one half feet per second. This gives good coverage and adequate buffing. If slower it takes too long to cover a lane.

The drive wheels are covered with a 45 durometer urethane covering which is vulcanized to the wheel. In petitioners device the covering is roughly ⅞ inch thick. Normal practice is to put a 3/16 inch or ¼ inch covering on the underlying wheel because of the expense of urethane. The added thickness on petitioners device gives more cushioning and better traction to the drive wheels. Lane surface can be damaged by the slipping of drive wheels. This slipping burns the lane surface.

The oiler is a cylindrical tank, having oil applicators extending outwardly. The applicators are forced into contact with the lane surface when the applicator solenoid is engaged and are forced along the lane surface as the machine moves forward.

The lane surface contacting material is ½ inch flock foam pad similar to foam pad used in paint applicators. The oil passes through the foam and is applied directly to the lane surface.

Rate of flow is adjusted by the number and size of orifice inserted into the tank. A light applicator would be ⅛ inch internal diameter, a heavy applicator 7/32 inch. Location of oil is controlled by placement of applicators on the oil tank.

I claim:

1. An automatic bowling lane maintenance machine for treating the surface of a bowling lane, having gutters at opposite side of the lane, such gutters having ends at the foul line, comprising:

a frame;

means for supporting the frame above the lane for longitudinal movement along the lane, parallel to the gutters;

a plurality of rotatable buffers mounted on such frame so as to make brushing contact with the lane surface, such plurality of buffers being of such width that the width of the brushed area is substantially the full width of the bowling lane between the gutters, such buffers being mounted so that the axes of rotation of the buffers are normal to the lane surface and such axes move longitudinally along the lane as the frame is moved longitudinally along the lane;

the rotatable buffers further comprising pivotally mounted flat blades, the pivotal mounting allowing limited vertical movement of the blades in a plane generally perpendicular to the axis of rotation of the blade to allow the blade when buffing to conform to vertical irregularities in the lane surface power means mounted on said frame for rotatably driving said buffers;

means for applying lane dressing to the bowling lane in front of the buffers;

drive means for driving said frame in a predetermined course in forward and reverse movement longitudinally along the lane.

2. An automatic bowling lane maintenance machine as set forth in claim 1 in which the pivotally mounted flat blades have fixedly attached to the bottom of such blades means for retaining replaceable lane buffing pads.

3. An automatic bowling lane maintenance machine as set forth in claim 1 wherein the plurality of buffers comprises a first buffer rotated in a clockwise direction as the machine is driven longitudinally down the lane; a second buffer, wider than the first buffer, mounted on the frame so that the width of the buffed area buffed by the second buffer is wider than that of the first buffer and therefore over laps the area buffed by the first buffer, such second buffer being rotated in a clockwise direction as the machine is driven longitudinally down the lane;

a third buffer rotated in counterclockwise direction as the machine is driven longitudinally down the lane, the area buffed by the third buffer being overlapped by the area buffed by the second buffer.

4. An automatic bowling lane maintenance machine comprising:

a frame means for supporting the frame above the lane for forward and rearward movement lengthwise of the bowling lane parallel to the gutters;

a plurality of buffing blades mounted on such frame so as to make buffing contact with the lane surface, substantially across the width of the lane;

a dressing oil reservoir pivotally mounted on such frame parallel to the lane surface;

dressing application means extending outwardly from such oil reservoir, in fluid transfer relation with the reservoir;

pivoting means operable to pivot such dressing oil reservoir on an axis parallel to the lane width, operable to force such dressing application means into contact with the lane surface;

control means operable to hold such lane dressing application means into contact with the lane surface over a predetermined distance, drive means for driving said frame in a predetermined course in a forward and reverse direction on the lane.

5. An automatic bowling lane maintenance machine as set forth in claim 4 in which;

the dressing oil reservoir is mounted on the frame immediately in front of the buffing means.

6. An automatic bowling lane maintenance machine as set forth in claim 4 in which the dressing application means comprises a plurality of hollow tubes having resilient pads mounted thereon in fluid transfer relation with the oil reservoir for the passage of dressing oil from the reservoir to the lane surface when the reservoir is pivoted and the pads are forced into contact with the lane surface.

7. An automatic bowling lane maintenance machine of the type in which a support frame and a reversible drive system, including surface engaging drive wheels advance the machine a predetermined distance in a forward and reverse direction longitudinally along a bowling lane while applying dressing to the lane and buffing the dressing into the lane, wherein the improvement comprises;

a plurality of rotatably mounted buffing blades mounted so as to make brushing contact with the lane surface, such blades being rotated in axes perpendicular to the lane surface; the distance between the axes of rotation of any two contiguous blades being less than the sum of radii of the brushed areas of the two contiguous blades; such buffing blades being mounted so that the brushed area of the lane is substantially the full width of the bowling lane; dressing application means mounted in front of the buffing blades, the rotatable buffing blades being pivotally mounted, padded blades, the pivotal mounting of the padded blades allowing limited vertical movement of the blades in a plane generally perpendicular to the axis of rotation of the blades to allow the blades when buffing to conform to irregularities in the lane surface.

8. An automatic bowling lane maintenance machine of the type in which a support frame and a reversible drive system, including surface engaging drive wheels, advance the machine a predetermined distance in a forward and reverse direction longitudinally along a bowling lane while applying dressing to the lane and buffing the dressing into the lane, wherein the improvement comprises;

a plurality of rotatably mounted buffing blades mounted so as to make brushing contact with the lane surface, such blades being rotated in axes perpendicular to the lane surface; such buffing blades being mounted so that the brushed area of the lane is substantially the full width of the bowling lane;

power means for rotatably driving such buffing blades;

a dressing reservoir pivotally mounted on such frame, the axis of pivoting of such reservoir being parallel to the width of the lane surface;

dressing application means extending outwardly from such oil reservoir;

pivoting means for pivoting such dressing application means into contact with the lane surface;

control means operable to hold such lane dressing application means into contact with the lane surface over a predetermined distance as the frame is driven longitudinally down the lane.

* * * * *